US006550255B2

(12) United States Patent
Rudick et al.

(10) Patent No.: US 6,550,255 B2
(45) Date of Patent: Apr. 22, 2003

(54) STIRLING REFRIGERATION SYSTEM WITH A THERMOSIPHON HEAT EXCHANGER

(75) Inventors: Arthur G. Rudick, Atlanta, GA (US); David M. Berchowitz, Athens, OH (US)

(73) Assignees: The Coca-Cola Company, Atlanta, GA (US); Global Cooling BV, Hz Zutphen (NL)

( * ) Notice: Subject to any disclaimer, the term of this patent is extended or adjusted under 35 U.S.C. 154(b) by 0 days.

(21) Appl. No.: 09/813,618

(22) Filed: Mar. 21, 2001

(65) Prior Publication Data

US 2002/0134088 A1 Sep. 26, 2002

(51) Int. Cl.[7] ..... F25B 9/00
(52) U.S. Cl. ..... 62/6
(58) Field of Search ..... 62/6, 119, 467, 62/515

(56) References Cited

U.S. PATENT DOCUMENTS

| | | | | |
|---|---|---|---|---|
| 1,815,170 | A | 7/1931 | Summers | |
| 2,095,008 | A | 10/1937 | Philipp | 62/115 |
| 2,342,299 | A | 2/1944 | Peet | 225/40 |
| 2,470,547 | A | 5/1949 | Childers | 62/103 |
| 2,512,545 | A | 6/1950 | Hazard | 62/125 |
| 2,660,037 | A | 11/1953 | Cooper | 62/116 |
| 2,672,029 | A | 3/1954 | Saunders | 62/117.2 |
| 2,885,142 | A | 5/1959 | Eberhart | 230/117 |
| 2,961,082 | A | 11/1960 | Hanson et al. | 194/13 |
| 3,004,408 | A | 10/1961 | Dros et al. | 62/419 |
| 3,206,943 | A | 9/1965 | Rice et al. | |
| 3,230,733 | A | 1/1966 | Rutishauser et al. | 62/256 |
| 3,302,429 | A | 2/1967 | Byrd | 62/514 |
| 3,580,003 | A | 5/1971 | Dolan | 62/115 |
| 3,712,078 | A | 1/1973 | Maynard et al. | 62/448 |
| 3,853,437 | A | 12/1974 | Horn et al. | 418/61 |
| 3,997,028 | A | 12/1976 | Lopez | 186/1 |
| 4,037,081 | A | 7/1977 | Aldridge et al. | 219/387 |
| 4,037,650 | A | 7/1977 | Randall | 165/29 |
| 4,138,855 | A | 2/1979 | Jahan et al. | 62/112 |
| 4,176,526 | A | 12/1979 | Missimer | 62/278 |
| 4,176,529 | A | 12/1979 | Stierlin et al. | 62/490 |
| 4,259,844 | A | 4/1981 | Sarcia et al. | 62/6 |
| 4,275,705 | A | 6/1981 | Schaus et al. | 126/110 R |

(List continued on next page.)

FOREIGN PATENT DOCUMENTS

| | | |
|---|---|---|
| DE | 233-266 | 7/1944 |
| DE | CH 233 266 | 7/1944 |
| EP | 0 065 995 | 12/1982 |
| EP | 1 167 900 | 1/2002 |
| FR | 2-609-789 | 7/1988 |
| JP | 64-36468 | 2/1989 |
| JP | 01 269874 | 10/1989 |
| JP | 2-217758 | 8/1990 |
| JP | 7-180921 | 7/1995 |
| JP | 8-320165 | 12/1996 |
| JP | WO 98/34076 | 8/1998 |
| JP | 0 935 063 A2 | 8/1999 |
| JP | 11-21083 | 9/2001 |
| WO | WO 02/16836 | 2/2002 |

OTHER PUBLICATIONS

Lyn Bowman, A Technical Introduction to Free–Piston Stirling Cycle Machines: Engines, Coolers, and Heat Pumps, May, 1993, pp. 1–7.

(List continued on next page.)

*Primary Examiner*—William C. Doerrler
*Assistant Examiner*—Malik N. Drake
(74) *Attorney, Agent, or Firm*—Sutherland Asbill & Brennan, LLP

(57) ABSTRACT

An enclosure for a refrigerated space. The enclosure may include a thermosiphon and a Stirling cooler. The thermosiphon may include a condenser end and an evaporator end. The ends may be connected by a small diameter pipe and a large diameter pipe. The Stirling cooler may drive the thermosiphon to cool the refrigerated space.

53 Claims, 6 Drawing Sheets

U.S. PATENT DOCUMENTS

| | | | | |
|---|---|---|---|---|
| 4,306,613 | A | 12/1981 | Christopher | 165/32 |
| 4,377,074 | A | 3/1983 | Jardine | 62/183 |
| 4,383,421 | A | 5/1983 | Quesnoit | 62/333 |
| 4,416,122 | A | 11/1983 | Johnson | 62/448 |
| 4,471,633 | A | 9/1984 | Tinsler | 62/295 |
| 4,480,445 | A | 11/1984 | Goldstein | 62/434 |
| 4,490,991 | A | 1/1985 | Griffin | 62/279 |
| 4,539,737 | A | 9/1985 | Kerpers et al. | 29/423 |
| 4,554,797 | A | 11/1985 | Goldstein | 62/434 |
| 4,558,570 | A | 12/1985 | Shtrikman et al. | 62/6 |
| 4,694,650 | A | 9/1987 | Vincent | 60/520 |
| 4,726,193 | A | 2/1988 | Burke et al. | 62/3 |
| 4,759,190 | A | 7/1988 | Trachtenberg et al. | 62/3 |
| 4,783,968 | A | 11/1988 | Higham et al. | 62/6 |
| 4,811,563 | A | 3/1989 | Furuishi et al. | 60/517 |
| 4,823,554 | A | 4/1989 | Trachtenberg et al. | 62/3 |
| 4,827,733 | A | 5/1989 | Dinh | 62/305 |
| 4,827,735 | A | 5/1989 | Foley | 62/430 |
| 4,831,831 | A | 5/1989 | Carter et al. | 62/59 |
| 4,843,826 | A | 7/1989 | Malaker | 62/6 |
| 4,882,911 | A | 11/1989 | Immel | 62/288 |
| 4,888,951 | A | 12/1989 | Beale | 60/520 |
| 4,922,722 | A | 5/1990 | Kazumoto et al. | 62/6 |
| 4,941,527 | A | 7/1990 | Toth et al. | 165/47 |
| 4,949,554 | A | 8/1990 | Branz et al. | 62/248 |
| 4,964,279 | A | 10/1990 | Osborne | 62/59 |
| 4,977,754 | A | 12/1990 | Upton et al. | 62/248 |
| 4,996,841 | A | 3/1991 | Meijer et al. | 60/525 |
| 5,069,273 | A | 12/1991 | O'Hearne | 165/12 |
| 5,076,351 | A | 12/1991 | Munekawa et al. | 165/104.21 |
| 5,094,083 | A | 3/1992 | Horn et al. | 62/6 |
| 5,142,872 | A | 9/1992 | Tipton | 62/6 |
| 5,228,299 | A | 7/1993 | Harrington et al. | 62/55.5 |
| 5,259,198 | A | 11/1993 | Viegas et al. | 62/7 |
| 5,259,214 | A | 11/1993 | Nagatomo et al. | 62/324.1 |
| 5,284,022 | A | 2/1994 | Chung | 62/6 |
| 5,303,769 | A | 4/1994 | Hoegberg | 165/108 |
| 5,305,825 | A | 4/1994 | Roehrich et al. | 165/64 |
| 5,309,986 | A | 5/1994 | Itoh | 165/104.26 |
| 5,311,927 | A | 5/1994 | Taylor et al. | 165/64 |
| 5,333,460 | A | 8/1994 | Lewis et al. | 62/6 |
| 5,341,653 | A | 8/1994 | Tippmann et al. | 62/288 |
| 5,347,827 | A | 9/1994 | Rudick et al. | 62/440 |
| 5,402,654 | A | 4/1995 | Rudick et al. | 62/448 |
| 5,406,805 | A | 4/1995 | Radermacher et al. | 62/81 |
| 5,417,079 | A | 5/1995 | Rudick et al. | 62/253 |
| 5,417,081 | A | 5/1995 | Rudick et al. | 62/440 |
| 5,438,848 | A | 8/1995 | Kim et al. | 62/342 |
| 5,440,894 | A | 8/1995 | Schaeffer et al. | 62/203 |
| 5,493,874 | A | 2/1996 | Landgrebe | 62/457.2 |
| 5,496,153 | A | 3/1996 | Redlich | 417/212 |
| 5,524,453 | A | 6/1996 | James | 62/434 |
| 5,525,845 | A | 6/1996 | Beale et al. | 310/30 |
| 5,537,820 | A | 7/1996 | Beale et al. | 60/517 |
| 5,542,257 | A | 8/1996 | Mattern-Klosson et al. | 62/55.5 |
| 5,551,250 | A | 9/1996 | Yingst et al. | 62/234 |
| 5,596,875 | A | 1/1997 | Berry et al. | 62/6 |
| 5,638,684 | A | 6/1997 | Siegel et al. | 62/6 |
| 5,642,622 | A | 7/1997 | Berchowitz et al. | 62/6 |
| 5,645,407 | A | 7/1997 | Kralick et al. | 417/383 |
| 5,647,217 | A | 7/1997 | Penswick et al. | 62/6 |
| 5,647,225 | A | 7/1997 | Fischer et al. | 62/434 |
| 5,649,431 | A | 7/1997 | Schroeder, Jr. | 62/434 |
| 5,655,376 | A | 8/1997 | Price | 62/6 |
| 5,678,409 | A | 10/1997 | Price | 62/6 |
| 5,678,421 | A | 10/1997 | Maynard et al. | 62/407 |
| 5,724,833 | A | 3/1998 | Devers | 62/625 |
| 5,735,131 | A | 4/1998 | Lambright, Jr. et al. | 62/99 |
| 5,782,106 | A | 7/1998 | Park | 62/452 |
| 5,794,444 | A | 8/1998 | Hofbauer et al. | 60/517 |
| 5,878,581 | A | 3/1999 | DeFrances et al. | 62/50.2 |
| 5,881,566 | A | 3/1999 | Shacklock et al. | 62/277 |
| 5,895,033 | A | 4/1999 | Ross et al. | 267/161 |
| 5,906,290 | A | 5/1999 | Haberkorn | 220/505 |
| 5,920,133 | A | 7/1999 | Penswick et al. | 310/17 |
| 5,927,079 | A | 7/1999 | Sekiya et al. | 62/6 |
| 5,927,080 | A | 7/1999 | Lee | 62/6 |
| 6,003,319 | A | 12/1999 | Gilley et al. | 62/3.7 |
| 6,023,937 | A | 2/2000 | Rodrigues | 62/295 |
| 6,067,804 | A | 5/2000 | Moeykens et al. | 62/84 |
| 6,073,547 | A | 6/2000 | Westbrooks, Jr. et al. | 99/468 |
| 6,079,481 | A | 6/2000 | Lowenstein et al. | 165/10 |
| 6,112,526 | A | 9/2000 | Chase | 62/6 |
| 6,148,634 | A | 11/2000 | Sherwood | 62/434 |
| 6,158,499 | A | 12/2000 | Rhodes | 165/10 |
| 6,178,770 | B1 | 1/2001 | Bradley, Jr. et al. | 62/434 |

OTHER PUBLICATIONS

B.D. Mennink et al., "Development of an Improved Stirling Cooler for Vacuum Super Insulated Fridges With Thermal Store and Photovoltaic Power Source for Industrialized and Developing Countries," May 10–13, 1994 pp. 1–9.

D.M. Berchowitz et al., "Recent Advances in Stirling Cycle Refrigeration," Aug. 20–25, 1995, 8 pages.

Kelly McDonald et al., "Stirling Refrigerator for Space Shuttle Experiments," Aug. 7/11, 1994; 6 pages.

Sunpower, Inc., "Introduction to Sunpower, Stirling Machines and Free–Piston Technology," Dec. , 1995.

D.M. Berchowitz et al., "Test Results for Stirling Cycle Cooled Domestic Refrigerators," Sep. 3–6, 1996, 9 pages.

Royal Vendors, Inc., "G–III All Purpose Vendor Operation and Service Manual," Sep., 1996, pp. 1–67.

D.M. Berchowitz et al., "Stirling Coolers for Solar Refrigerators," 10 pages.

Michael K. Ewert et al., "Experimental Evaluation of a Solar PV Refrigerator with Thermoelectric, Stirling and Vapor Compression Heat Pumps," 7 pages.

D.M. Berchowitz, Ph.D., "Maximized Performance of Stirling Cycle Refrigerators," 8 pages.

David Bergeron, "Heat Pump Technology Recommendation for a Terrestrial Battery–Free Solar Refrigerator," Sep., 1998, pp. 1–25.

Seon–Young Kim, et al., "The Application of Stirling Cooler to Refrigeration," pp. 1023–1026.

R.H. Green, et al., "The Design and Testing of a Stirling Cycle Domestic Freezer," pp. 153–161.

Abstract of Japanese Publication No. 02302563 (Toshiba Corp.) Dec. 14, 1990.

Abstract of Japanese Publication No. 03036468 (Toshiba Corp.) Feb. 18, 1991.

Abstract of Japanese Publication No. 03294753 (Toshiba Corp.) Dec. 25, 1991.

Abstract of Japanese Publication No. 04217758 (Toshiba Corp.) Aug. 7, 1992.

Abstract of Japanese Publication No. 05203273 (Toshiba Corp.) Aug. 10, 1993.

Abstract of Japanese Publication No. 05306846 (Toshiba Corp.) Nov. 19, 1993.

Abstract of Japanese Publication No. 07180921 (Toshiba Corp.) Jul. 18, 1995.

Abstract of Japanese Publication No. 08005179 (Toshiba Corp.) Jan. 12, 1996.

Abstract of Japanese Publication No. 08100958 (Toshiba Corp.) Apr. 16, 1996.

Abstract of Japanese Publication No. 08247563 (Toshiba Corp.) Sep. 27, 1996.

STIRLING REFRIGERATION SYSTEM WITH A THERMOSIPHON HEAT EXCHANGER

FIELD OF THE INVENTION

The present invention relates generally to refrigeration systems and more specifically relates to refrigeration systems that use a Stirling cooler in cooperation with a thermosiphon as the mechanism for removing heat from a desired space.

BACKGROUND OF THE INVENTION

In the beverage industry and elsewhere, refrigeration systems are found in vending machines, glass door merchandisers ("GDM's") and other types of dispensers and coolers. In the past, these units generally have used a conventional vapor compression (Rankine cycle) refrigeration apparatus to keep beverages or containers cold. In the Rankine cycle apparatus, the refrigerant in the vapor phase is compressed in a compressor so as to cause an increase in temperature. The hot, high-pressure refrigerant is then circulated through a heat exchanger, called a condenser, where it is cooled by heat transfer to the surrounding environment. As a result of the heat transfer to the environment, the refrigerant condenses from a gas back to a liquid. After leaving the condenser, the refrigerant passes through a throttling device where the pressure and temperature of the refrigerant are reduced. The cold refrigerant leaves the throttling device and enters a second heat exchanger, called an evaporator, located in or near the refrigerated space. Heat transfer with the evaporator and the refrigerated space causes the refrigerant to evaporate or change from a saturated mixture of liquid and vapor into a superheated vapor. The vapor leaving the evaporator is then drawn back into the compressor so as to repeat the cycle.

Stirling cycle coolers are also a well known as heat transfer mechanisms. Briefly, a Stirling cycle cooler compresses and expands a gas (typically helium) to produce cooling. This gas shuttles back and forth through a regenerator bed to develop much greater temperature differentials than may be produced through the normal Rankine compression and expansion process. Specifically, a Stirling cooler may use a displacer to force the gas back and forth through the regenerator bed and a piston to compress and expand the gas. The regenerator bed may be a porous element with significant thermal inertia. During operation, the regenerator bed develops a temperature gradient. One end of the device thus becomes hot and the other end becomes cold. See David Bergeron, *Heat Pump Technology Recommendation for a Terrestrial Battery-Free Solar Refrigerator,* September 1998. Patents relating to Stirling coolers include U.S. Pat. Nos. 5,678,409; 5,647,217; 5,638,684; 5,596,875 and 4,922,722, all incorporated herein by reference.

Stirling cooler units are desirable because they are nonpolluting, efficient, and have very few moving parts. The use of Stirling cooler units has been proposed for conventional refrigerators. See U.S. Pat. No. 5,438,848, incorporated herein by reference. The integration of a free-piston Stirling cooler into a conventional refrigerated cabinet, however, requires different manufacturing, installation, and operational techniques than those used for conventional compressor systems. See D. M. Berchowitz et al., *Test Results for Stirling Cycle Cooler Domestic Refrigerators,* Second International Conference. As a result, the use of the Stirling coolers in, for example, beverage vending machines, GDM's, and other types of dispensers, coolers, or refrigerators is not well known.

Another known heat transfer device is a thermosiphon. In general, a thermosiphon is an efficient closed loop heat transfer system that uses a phase change refrigerant. The thermosiphon may have a condenser end and an evaporator end. In the condenser end, heat is transferred out of the phase change refrigerant so as to turn the gas to a liquid. The liquid travels by the force of gravity to the evaporator end where heat is again added so as to change the liquid back to a gas. The gas then rises and returns to the condenser end. The process is repeated in a closed cycle.

To date, the use of a thermosiphon in beverage vending machines, GDM's, beverage dispensers, or similar types of refrigerated devices is not well known. Likewise, the use of a thermosiphon with a Stirling cooler is not well known. Both devices, individually and in combination, however, may provide increased efficiencies in terms of performance, energy demands, and overall operating costs.

A need exists therefore for adapting Stirling cooler technology to conventional beverage vending machines, GDM's, dispensers, and the like. Likewise, there is a need for adapting Stirling cooler technology to thermosiphon technology in general and to conventional beverage machines, GDM's, dispensers, and the like.

SUMMARY OF THE INVENTION

The present invention thus provides an enclosure for a refrigerated space. The enclosure may include a thermosiphon and a Stirling cooler. The thermosiphon may include a condenser end and an evaporator end. The ends may be connected by a small diameter pipe and a large diameter pipe. The Stirling cooler may drive the thermosiphon to cool the refrigerated space.

Specific embodiments of the present invention may include the use of a phase change refrigerant in the thermosiphon. The phase change refrigerant may be carbon dioxide. The small diameter pipe may have a diameter of about 0.5 to about 3 millimeters and the large diameter pipe may have a diameter of about 3 to about 10 millimeters. The condenser end may include a condenser positioned adjacent to the Stirling cooler. The condenser may include a condenser block and/or a number of condenser coils. The evaporator end may include an evaporator such as a fin and tube evaporator. The Stirling cooler may include a cold end and a hot end, with the cold end in contact with the thermosiphon. A number of thermosiphons and a number of Stirling coolers may be used. An air movement device also may be used so as to force air through the refrigerated space and the evaporator end of the thermosiphon.

A further embodiment of the present invention may provide for a refrigerator, such as a glass door merchandiser. The refrigerator may include an insulated frame. The insulated frame may include a refrigerated space and a refrigeration deck area. A removable refrigeration deck may be positioned within the refrigeration deck area. The removable refrigeration deck may include a thermosiphon and a Stirling cooler. The insulated frame may include a number of walls defining the refrigeration deck area. The walls may further define a baffle area. A drain hole may extend between the refrigeration deck area and the baffle area. An air passageway may extend between the refrigerated space and the refrigeration deck area.

The thermosiphon may include a condenser end and an evaporator end. The condenser end may include a condenser positioned adjacent to the Stirling cooler. The evaporator end may include a fin and tube type evaporator. A number of thermosiphons and a number of Stirling coolers may be used.

The refrigeration deck also may include a top plate. The refrigeration deck may include a means to mount the Stirling cooler to the top plate. The top plate may be an insulated spacer. The top plate may include a number of apertures therein for airflow therethrough and a handle thereon so as to remove the refrigeration deck. The refrigeration deck also may include an air movement device.

The refrigerator also may include an insulated box surrounding the thermosiphon and the Stirling cooler. The refrigeration deck area may have a first set of rails positioned therein while the insulated box may have a second pair of rails positioned thereon such that the insulated box may be slid in and out of said refrigeration deck area.

A further embodiment of the present invention provides for a refrigeration deck for a refrigerated space. The refrigeration deck may include a plate. A Stirling cooler may be mounted to the plate and a thermosiphon may be connected to the Stirling cooler. The plate may be an insulated spacer. The plate may include a number of apertures therein for airflow therethrough and a handle thereon so as to remove the refrigeration deck. The refrigeration deck also may include an air movement device. The Stirling cooler may include a cold end and a hot end. The plate may include an aperture therein such that the cold end of the Stirling cooler is positioned on a first side of the plate and the hot end of the Stirling cooler is positioned on the second side.

The thermosiphon may include a condenser block positioned on the cold end of the Stirling cooler. The condenser block may include a mounting flange formed thereon. The refrigeration deck may include an attachment ring attached to the mounting flange so as to join the condenser block and the cold end of the Stirling cooler. The plate also may include an indentation surrounding the aperture. The refrigeration deck may include a vibration mount positioned within the indentation and supporting the mounting flange and the Stirling cooler. The vibration mount may include a ring of elastomeric material. The aperture may include an insulation ring positioned therein.

The thermosiphon also may include a number of condenser coils positioned about the cold end of the Stirling cooler. The Stirling cooler may include an outer casing with a number of flanges extending therefrom. The refrigeration deck may include a number of isolation mounts so as to connect the flanges of the Stirling cooler to the plate. The isolation mounts may include several cylinders of an elastomeric material. The aperture may include an insulation ring positioned therein.

The refrigeration deck also may include an insulated box defined by the plate. Either the plate or the insulated box may have a pair of guide rails positioned thereon. The plate may have a condenser aperture positioned therein so as to position the Stirling cooler. The plate also may have a fan aperture therein so as to position the fan.

The method of the present invention may cool an enclosure with a thermosiphon. The thermosiphon may have a phase change refrigerant therein, a condenser positioned adjacent to a cold end of a Stirling cooler, and an evaporator. The method may include the steps of removing heat from the phase change refrigerant at the condenser by the Stirling cooler so as to turn the phase change refrigerant to a liquid, flowing the phase change refrigerant to the evaporator, forcing air past the evaporator and into the enclosure so as to cool the enclosure, adding heat to the phase change refrigerant at the evaporator by the forced air so as to turn the phase change refrigerant to a vapor, and rising the phase change refrigerant to the condenser.

Other objects, features, and advantages of the present invention will be come apparent upon review of the following specification, when taken in conjunction with the drawings and the appended claims.

BRIEF DESCRIPTION OF THE DRAWINGS

FIG. 7 is a cross-sectional view of the refrigeration system taken along line 7—7 of FIG. 5.

DETAILED DESCRIPTION OF THE INVENTION

Figure 1:
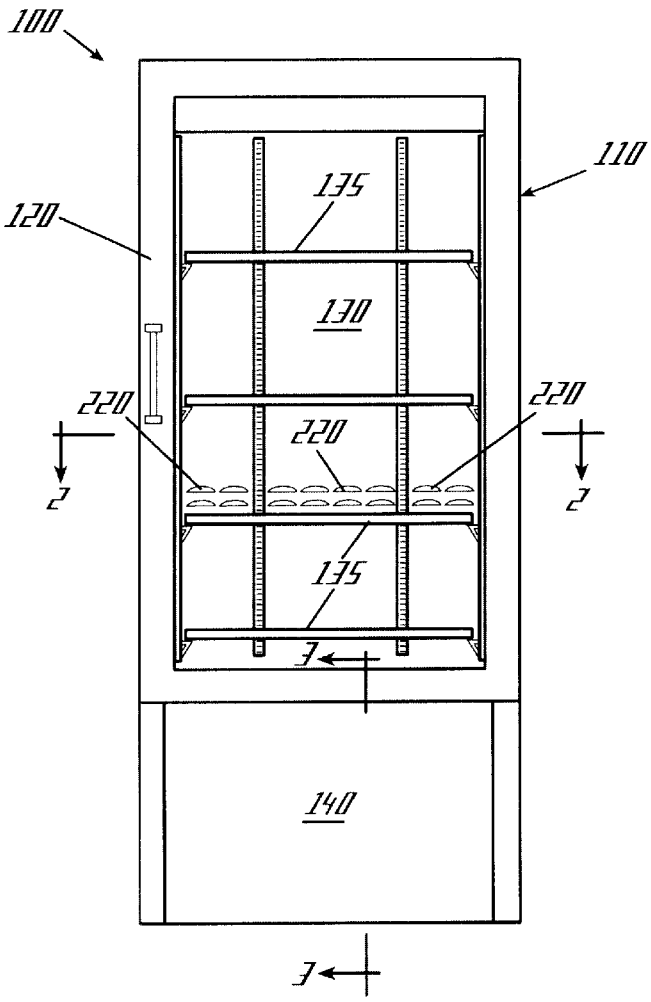
FIG. 1 is a plan view of a glass door merchandiser.
Figure 2:
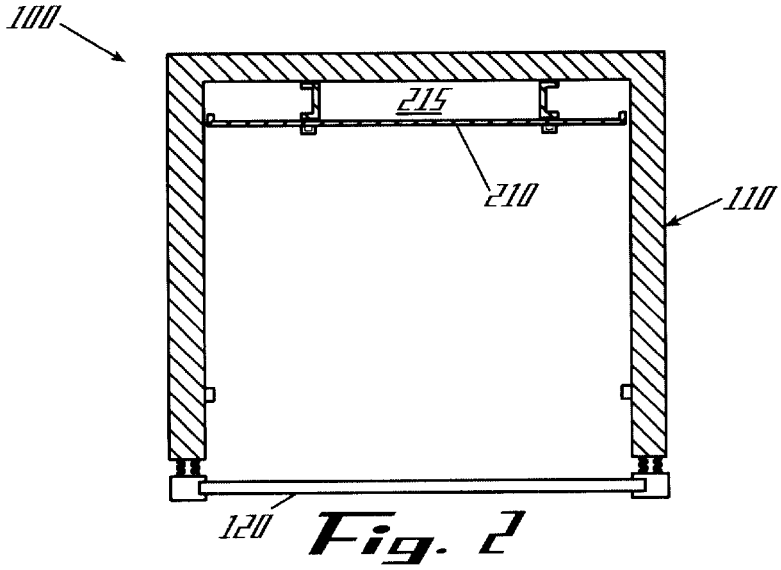
FIG. 2 is a top cross-sectional view of the glass door merchandiser of FIG. 1 taken along line 2—2 of FIG. 1.
Figure 3:
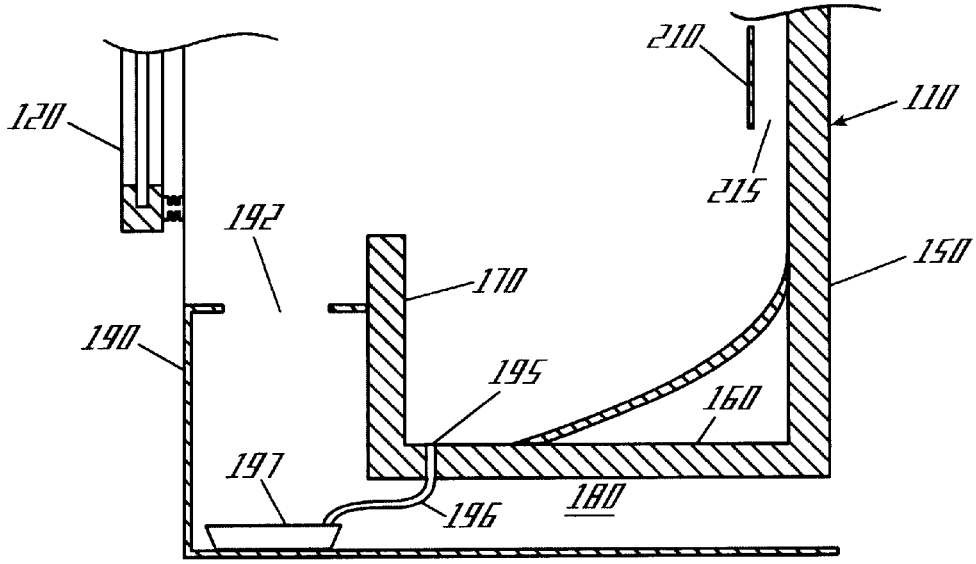
FIG. 3 is a side cross-sectional view of the glass door merchandiser of FIG. 1 taken along line 3—3 of FIG. 1.

Referring now to the drawings, in which like numerals indicate like elements throughout the several views, FIGS. 1–3 show a glass door merchandiser 100 ("GDM 100") for use with the present invention. The GDM 100 may be of conventional design. By way of example, the GDM 100 may be made by The Beverage-Air Company of Spartanburg, South Carolina and sold under several designations. Although the use of the GDM 100 is described herein, it is understood that the invention is applicable to vending machines, beverage dispensers, refrigerators, or any type of refrigerated enclosure.

Generally described, the GDM 100 may include an outer insulated frame 110 and an outer door 120. The GDM 100 also generally includes a refrigerated area 130 with a number of internal shelves 135 positioned therein for storing and offering for sale or use a number of refrigerated products. Any configuration of the frame 110, the door 120, and the shelves 135 may be used herein.

The GDM 100 also may include a refrigeration deck area 140 for the location of a refrigeration deck as described in more detail below. The refrigeration deck area 140 may be defined by a rear wall 150 of the frame 110. The rear wall 150 may not descend all the way to the bottom of the frame 110. Rather, a base wall 160 may extend from the rear wall 150 towards the front of the frame 110. The base wall 160 may not extend the entire width of the frame 110. Rather, the base wall 160 may extend into a divider wall 170 so as to define the refrigerated and the nonrefrigerated areas of the refrigeration deck area 140. The rear wall 150, the base wall 160, and the divider wall 170 preferably are all insulated with foamed polyurethane, vacuum insulated panels, or similar types of structures or materials. The walls 150, 160, 170 may define an enclosure for the refrigeration components as described below. The respective lengths and configurations of the walls 150, 160, 170 may depend upon the size of the GDM 100 as a whole and the size of the refrigeration components as described in more detail below.

Positioned underneath the base wall 160 and extending for the remaining vertical length of the frame 110 may be a baffle area 180. The baffle area 180 also may have a heat shroud 190 with an aperture 192 therein. The heat shroud 190 and the aperture 192 allow for the insertion and the removal of the refrigeration components as described below. The baffle area 180 may lead to an air exit 200. The base wall 160 also may have a drain hole 195 extending therethrough. The drain hole 195 may accept condensate from the refrigeration components as explained in more detail below. A hose 196 may lead from the drain hole 195 to a condensate pan 197 positioned within the baffle area 180. The hose 196 may be any type of conventional flexible tubing or the like.

The GDM 100 also may have a false back 210 spaced from the rear wall 150 of the frame 110. The false back 210 may create an air passageway 215 from the refrigeration deck area 140 along the length of the frame 110 so as to distribute refrigerated air. The false back 210 may have a number of louvers 220 or other type of openings therein so as to circulate the refrigerated air into the refrigerated section 130.

Although the present invention has been described in terms of the refrigeration deck area 140 and the false back 210, it is important to note that the GDM 100 may accommodate any configuration of refrigeration components or circulation systems. The design and organization of the GDM 100 does not limit the scope or applicability of the refrigeration components as described below.

Figure 4:
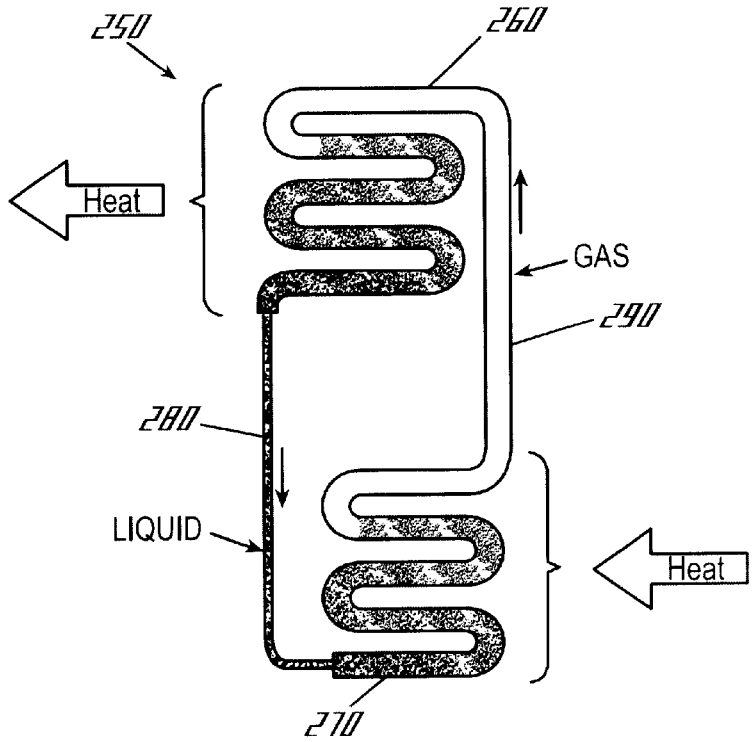
FIG. 4 is a schematic representation of the thermosiphon.

The present invention may use a thermosiphon heat exchanger 250 to cool the refrigerated section 130 of the GDM 100. In its basic form as described above, the thermosiphon 250 may be a closed looped heat exchanger system. The thermosiphon 250 may use carbon dioxide as the phase change refrigerant. Other refrigerants, such as acetone, ethylene, or isobutane also may be used. As is shown in FIG. 4, the thermosiphon 250 may include a condenser end 260 and an evaporator end 270. The condenser end 260 and the evaporator end 270 may be connected on the liquid side with a small diameter pipe 280 and on the vapor end by a large diameter pipe 290. The size of the pipes 280, 290 may depend upon the size of the refrigeration components as well as the size and desired capacity of the GDM 100 as a whole. For example, if the thermosiphon 250 has a capacity of 200 Watts, the small diameter pipe 280 may have a diameter of about 1.6 to about 2.0 millimeters and the large diameter pipe 290 may have a diameter of about 4.0 to about 6.0 millimeters. The overall sizes of the small diameter pipe 280 may range from about 0.5 to about 3 millimeters while the large diameter pipe 290 may range from about 3 to about 10 millimeters.

In operation of the thermosiphon 250, heat is pulled out of the carbon dioxide gas at the condenser end 260 and changes phase from a gas to a liquid. Gravity draws a continuous stream of the liquid carbon dioxide down the small diameter pipe 280 to the evaporator end 270. The small diameter of the pipe 280 ensures that the liquid continuously fills the pipe 280 without interruption. In the evaporator end 270, heat is transferred from the air blowing therethrough to the carbon dioxide liquid so as to change its phase from a liquid to a gas. The gas then rises to the top of the evaporator end 270 and through the large diameter pipe 290 back to the condenser 260. The rising carbon dioxide gas replaces the carbon dioxide gas that is continuously being condensed in the condenser end 260.

The thermosiphon 250 may be used in conjunction with one or more Stirling coolers 300. As is well known, the Stirling cooler 300 may include a cold end 310 and a hot end 320. A regenerator 330 may separate the cold end 310 and the hot end 320. The Stirling cooler 300 may be driven by a free piston (not shown) positioned within a casing 340. An outer tube 326 may surround the casing 340. A radial fin heat exchanger 325 may be located between the hot end 320 and the outer tube 326. An internal fan 350 may draw air through the heat exchanger 325 so as to remove waste heat from the hot end 320. The Stirling cooler 330 for use with the present invention may be made by Global Cooling, Inc. of Athens, Ohio and sold under the designation M100B. Any conventional type of Stirling cooler 300, however, may be used.

Figure 5:
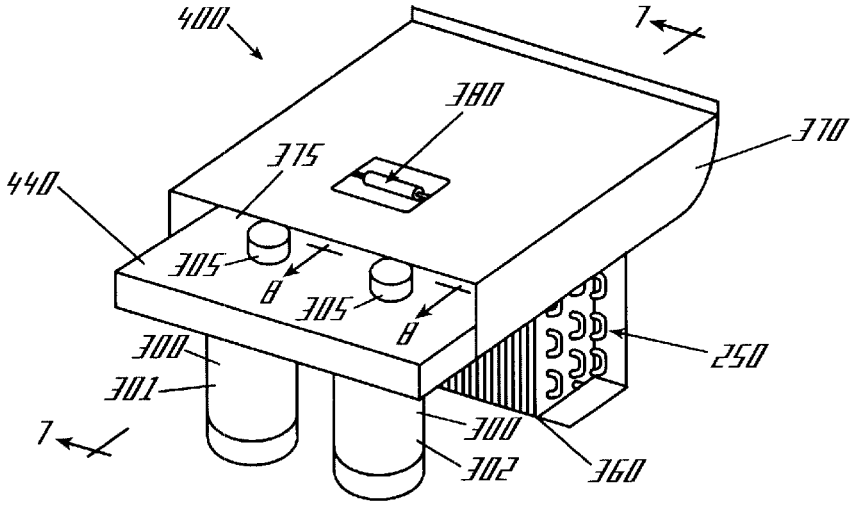
FIG. 5 is a perspective view of the refrigeration system of the present invention.
Figure 6:
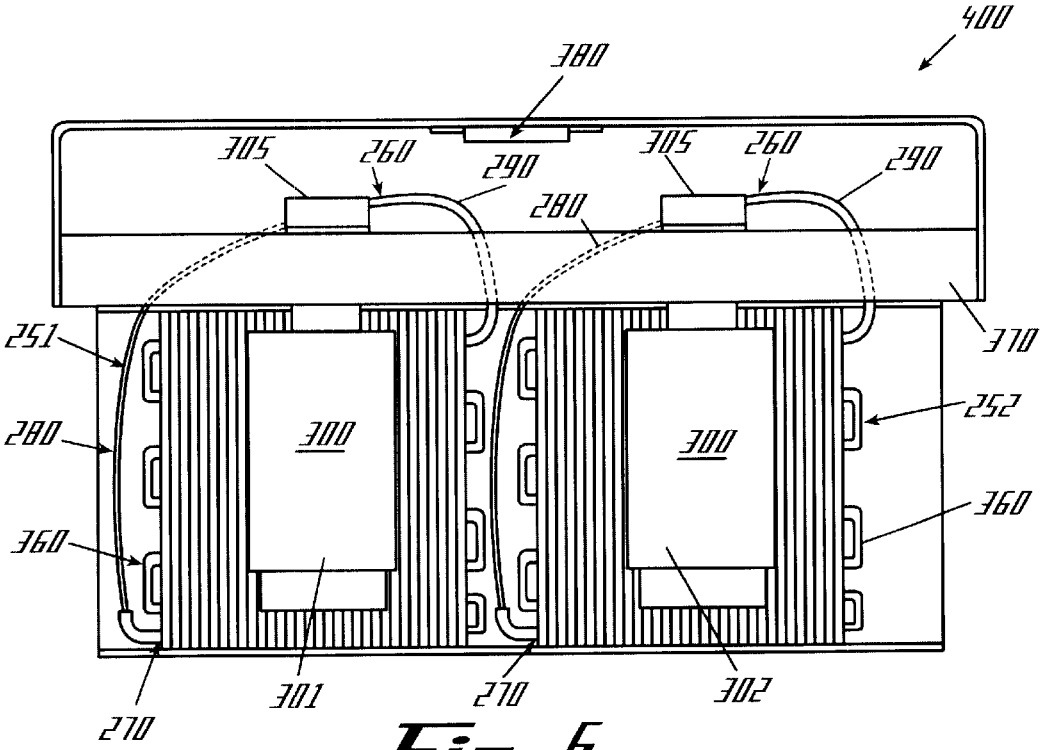
FIG. 6 is a side plan view of the refrigeration system of FIG. 5.
Figure 1:
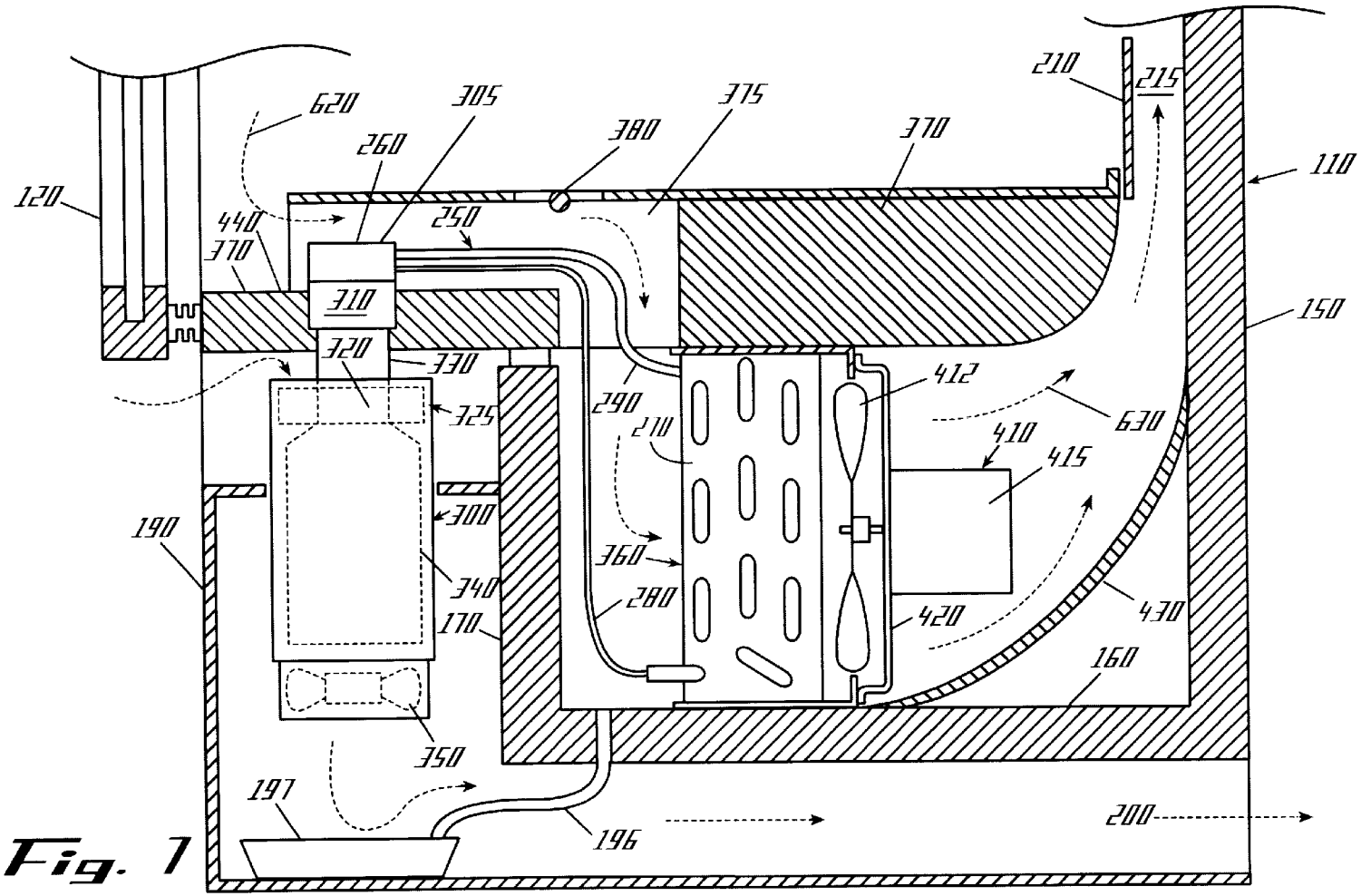

FIGS. 5–7 show the use of the thermosiphon 250 and the Stirling cooler 300. In this example, two (2) thermosiphons 250, a first thermosiphon 251 and a second thermosiphon 252, are used with two Stirling coolers 300, a first Stirling cooler 301 and a second Stirling cooler 302. Any number of thermosiphons 250 and Stirling coolers 300, however, may be used depending upon the size and desired capacity of the GDM 100 as a whole. As is shown, the condenser end 260 of the thermosiphons 250 may be attached to a condenser 305 associated with the cold end 310 of the Stirling coolers 300. Likewise, the evaporator end 270 of the thermosiphons 250 may be attached to a tube and fin type heat exchanger 360. As described above, the condenser end 260 of the thermosiphons 250 may be connected to the evaporator end 270 via the small diameter pipe 280 on the fluid side and via the large diameter pipe 290 the vapor side. Any type of condenser 305 or heat exchanger 360 may be used herein.

The thermosiphons 250 and the Stirling coolers 300 may be positioned within a removable refrigeration deck 400. The refrigeration deck 400 may be sized to fit within the refrigeration deck area 140 of the GDM 100. The thermosiphons 250 and the Stirling coolers 300 may be mounted within an insulated spacer 370. The insulated spacer 370 may be a plate-like structure made out of sheet metal or other types of rigid materials and may be insulated with polyurethane foam, expanded polystyrene foam, or similar types of materials. The insulated spacer 370 may extend on top of the heat exchanger 360 and may separate the cold ends 310 of the Stirling coolers 300 from the hot ends 320. The insulated spacer 370 may have one or more apertures 375 therein for airflow therethrough. The insulated spacer 370 also may have a handle 380 positioned thereon. The handle 380 allows the insulated spacer 370 and the refrigeration deck 400 as a whole to be pulled out of or to be placed into the refrigeration deck area 140. The refrigeration deck 400 as a whole and the individual components therein may take any convenient form or position.

The refrigeration deck 400 also may include one or more fans 410. The fans 410 each may include one or more fan blades 412 driven by a fan motor 415. The fan 410 may be any type of air movement device. Although the term "fan" 410 is used herein, the fan may be any type of air movement device, such as a pump, a bellows, a screw, and the like known to those skilled in the art. The fan 410 may have a capacity of about 150 to about 300 cubic feet per minute. The fan 410 may be positioned underneath the insulated spacer 370 and adjacent to the heat exchanger 360. The fan 410 may be attached to the heat exchanger 360 via an evaporator bracket 420. An air deflection plate 430 may be attached to the base wall 160 and the rear wall 150. The air deflection plate 430 ensures that the airflow through the fan 410 is directed in the proper direction towards the air passageway 215. Alternatively, the fan 410 may be attached directly to the frame 110 rather than to the refrigeration deck 400.

Figure 8:
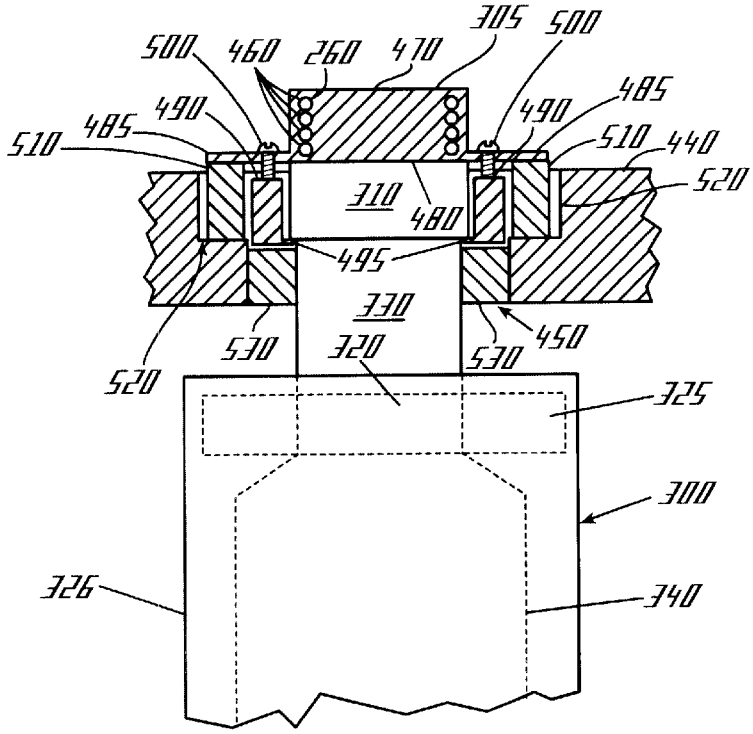
FIG. 8 is a cross-sectional view of a thermosiphon taken along line 8—8 of FIG. 5.

The Stirling coolers 300 may be mounted to the insulated spacer 370 in several ways. Specifically, the Stirling cooler 300 may be positioned within an insulated Stirling plate 440 that extends from, and may be a part of, the insulated spacer 370. As is shown in FIG. 8, the Stirling plate 440 may have an aperture 450 therein. The aperture 450 may be sized to permit at least the cold end 310, the hot end 320, and the regenerator 330 of the Stirling cooler 300 to pass therethrough. In this embodiment, a number of coils 460 of the condenser 305 are cast into a block 470. The block 470 may be made out of aluminum or other types of materials with good heat transfer characteristics. The block 470 may have a bottom perimeter 480 with a mounting flange 485 extending therefrom. An attachment ring 490 may connect the cold end 310 of the Stirling cooler 300 to the bottom of the block 470 via the mounting flange 480. The attachment ring 490 may be held in place by a number of screws 500. The attachment ring 490 also may have a bottom flange 495 so as to catch the cold end 310 of the Stirling cooler 300. The attachment ring 490 may be made out of steel, aluminum, plastic, or similar materials.

A vibration mount 510 may be located between the mounting flange 480 and an indentation 520 positioned adjacent to the aperture 450 in the Stirling plate 440. The vibration mount 510 may have a substantially toroidal shape and may be made out of an elastomeric material such as polyurethane, rubber, or similar types of materials. The vibration mount 510 may carry the weight of the Stirling cooler 300 and the condenser 305 of the thermosiphon 250. The vibration mount 510 acts to limit the amount of vibration transferred from the Stirling coolers 300 to the GDM 100 as a whole. Further, the aperture 450 also may be filled with an insulation ring 530. The insulation ring 530 may insulate the cold end 310 of the Stirling cooler 300 from the ambient air. The insulation ring 530 also may be in a substantially toroidal shape and may be made out of a compliant material such as closed cell foam, elastomeric foam, or similar types of materials.

Figure 9:
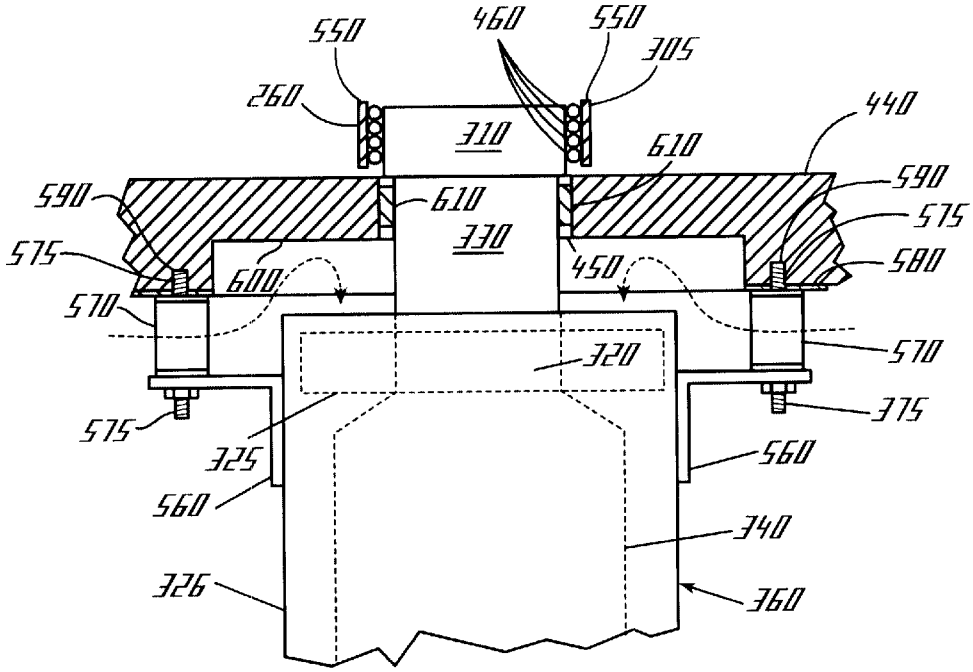
FIG. 9 is cross-sectional view of an alternative thermosiphon taken along line 8—8 of FIG. 5.

FIG. 9 shows an alternative embodiment for connecting the Stirling cooler 300 to the Stirling plate 440. In this embodiment, the coils 460 of the condenser 305 of the thermosiphon 250 are wrapped directly around the cold end 310 of the Stirling cooler 300. The coils 460 may be a number of small tubes arranged circumferentially around the cold end 310 of the Stirling cooler 300. A band 550 may keep the coils 460 firmly in contact with the cold end 310. The band 550 may be similar to a worm drive hose clamp. The Stirling plate 440 also may have an aperture 450 therein of sufficient size to allow the cold end 310 of the Stirling cooler 300 to pass therethrough. One or more flanges 560 may be attached to the casing 340 or the outer tube 346 of the Stirling cooler 300. The flanges 560 may attach to the Stirling plate 440 via one or more vibration isolation mounts 570. The vibration isolation mounts 570 may be of conventional design. The vibration isolation mounts 570 may include an elastomeric cylinder with attachment features 575 on each end. The vibration mount 570 acts to limit the amount of vibration transferred from the Stirling coolers 300 to the GDM 100 as a whole.

The Stirling plate 440 also may have an under surface 580. The under surface 580 may be made out of sheet metal or similar types of rigid materials. The under surface 580 may have a number of threads 590 positioned therein. The threads 590 may accept the attachment features 575 of the vibration isolation mounts 570 for attachment thereto. The vibration isolation mounts 570 therefore may carry the weight of the Stirling cooler 300 and the condenser 305 of the thermosiphon 250. The Stirling plate 440 also may have an indentation 600 positioned therein. The indentation 600 may be necessary to allow unrestricted airflow through the radial fin heat exchangers 325 of the hot end 320 of the Stirling cooler 300. An insulation ring 610 may be positioned within the aperture 450 so as to insulate the cold end 310 of the Stirling cooler 300 from the ambient air. The insulation ring 610 may be in a substantially toroidal shape and may be made out of a compliant material such as closed cell foam, elastomeric foam, or similar types of materials. Although FIGS. 8 and 9 show various ways to mount the Stirling coolers 300 within the refrigeration deck 400, any convenient means may be used.

In use, the refrigeration deck 400 may be lifted into and out of the refrigeration deck area 140 of the GDM 100 via the handle 380. The positioning of the refrigeration deck 400 within the refrigeration deck area 140 may form an in-take air passageway 620 for the passage of air from the refrigerated area 130 to the refrigeration deck 400. Likewise, the refrigeration deck 400 also may form an out-take air passageway 630 in line with the air passageway 215 of the false back 210. The air deflection plate 430 may align with the rear wall 150 and the base wall 160 so as to direct the airflow 630 towards the air passageway 215 of the false back 210.

Return air is drawn through the in-take air pathway 620 and between the bottom of the insulated plate 370 and the Stirling plate 440 through the aperture 375. The air thus passes the condensers 305 attached to the cold ends 310 of the Stirling coolers 300. The cold ends 310 of the Stirling coolers 300 remove heat from the phase change refrigerant within the condenser end 260 of the thermosiphon 250, thus changing the internal refrigerant to a liquid. The liquid then drains down the small diameter pipe 280 to the heat exchanger 360 at the evaporator end 270 in a continuous manner.

The airflow continues down between the divider wall 170 and the front surface of the heat exchanger 360. The airflow is cooled as it passes through the heat exchanger 360. Heat is removed from the air stream and transferred to the phase change refrigerant at the evaporator end 270 of the thermosiphon 250. This heat changes the internal refrigerant back to a gas. The gas thus rises through the large diameter pipe 290 back to the condenser end 260.

The chilled air stream thus continues through the heat exchanger 360, through the fan 410, and up along the air deflection plate 430. The air stream then continues through the out-take air pathway 630 into the false back 210 of the GDM 100. This air stream then becomes the cabinet supply air as it pass through the louvers 220 into the refrigerated space 130. The process may then be repeated.

Any condensate created by the heat exchanger 360 may drip through the drain hole 195 in the base wall 160 and into the tube 196 and the condensate pan 197. Ambient air may be drawn through the radial fin heat exchanger 325 of the hot end 320 of the Stirling cooler 300 and out via the air exit 200. The waste heat from the Stirling coolers 300 may help to evaporate the condensate.

The refrigeration deck 400 of the present invention may therefore maintain the GDM 100 with the refrigerated space 130 with a temperature of about zero (0) to about 7.2 degrees Celsius. The refrigeration deck 400 components may last approximately eight (8) to about twelve (12) years of continuous operation with routine maintenance. These figures are in contrast to the expected lifetime of about eight (8) to about ten (10) years for a conventional GDM with a Rankine cycle refrigeration. Further, the Stirling cooler 300, and thus the GDM 100 as a whole, should use significantly less energy than the Rankine cycle systems, without the production of noxious gases.

Figure 10:
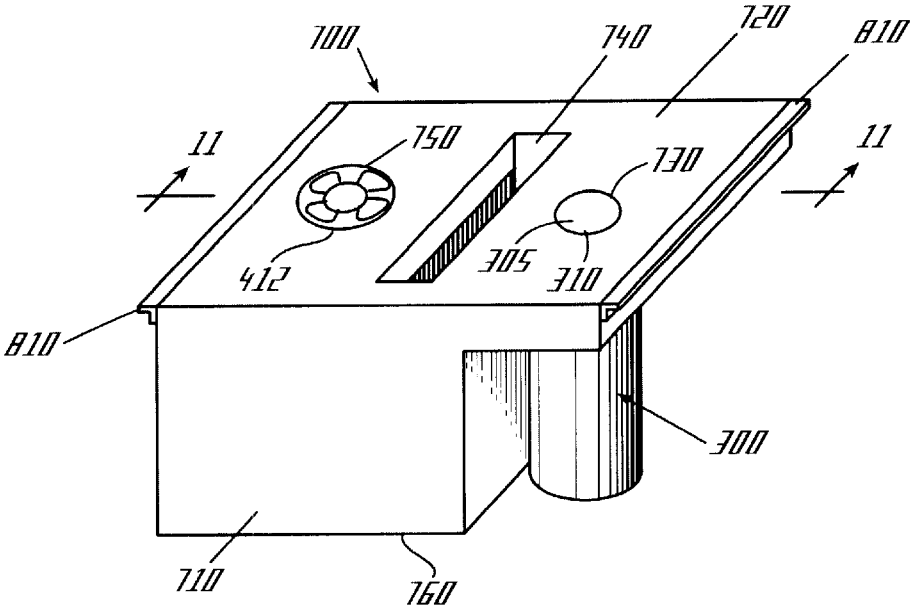
FIG. 10 is a perspective view of an alternative refrigeration deck.
Figure 11:
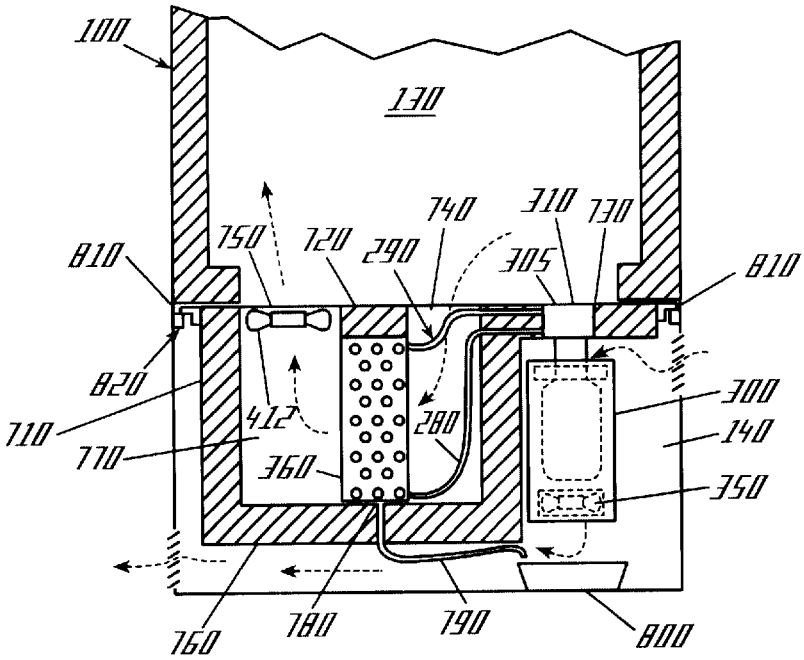
FIG. 11 is a side cross-sectional view of the refrigeration deck of FIG. 10 taken along line 11—11.

FIGS. 10 and 11 show an alternative embodiment of the present invention. This embodiment shows the use of a slide-in refrigeration deck 700. The components of the slide-in refrigeration deck 700 may be positioned within an insulated box 710. The insulated box 710 may be made out of foamed polyurethane, vacuum insulated panels, or similar types of structures or materials. The insulated box 710 may have a top wall 720. The top wall 720 may be similar to the insulated spacer 370. The top wall 720 may have a condenser aperture 730 positioned therein. The condenser 305 of the thermosiphon 250 and the cold end 310 of the Stirling cooler 300 may be mounted within the condenser aperture 730. The top wall 720 may have one or more condenser apertures 730 depending upon the number of the Stirling coolers 300 and the thermosiphons 250 used. The top wall 720 also may have an in-take air aperture 740 and a fan aperture 750. The fan 410 may be positioned within the fan aperture 750.

The insulated box 710 also may be defined by a bottom wall 760 and an interior space 770. Positioned within the interior space 770 of the insulated box 710 and extending from the bottom wall 760 to the top wall 720 may be the heater exchanger 360. The heater exchanger 360 may be in contact with the evaporator 270 of the thermosiphon 250 and connected to the condenser 305 associated with the cold end 310 of the Stirling coolers 300 via the large and small diameter tubing 280, 290. The bottom wall 760 of the insulated box 710 also may have a drain aperture 780 positioned therein. The drain aperture 780 may have a tube 790 positioned therein. Any condensate that collects on the heat exchanger 360 may drip into the drain aperture 780 and out the tube 790. A collection pan 800 may be positioned underneath or in communication with the tube 790 so as to collect the condensate in a manner similar to that described above.

The insulated box 710 also may have a pair of rails 810 positioned thereon. Likewise, the refrigeration deck area 140 of the GDM 100 may have a corresponding set of rail supports 820 such that the refrigeration deck 700 can slide in and out of the refrigeration deck area 140. The refrigeration deck 700 may slide into the front, rear, or either side of the GDM 100.

In use, the slide-in refrigeration deck 700 is slid into the refrigeration deck 140 along the rails 810, 820. The Stirling coolers 300 and the thermosiphons 250 operate in a manner similar to that described above. The fan 410 forces the in-take air through the in-take air aperture 740, into the heat exchanger 360, and out via the fan aperture 750. Further, this embodiment may provide somewhat increased cooling efficiency in that the cold end 310 of the Stirling cooler 300 is in direct communication with the refrigerated section 130 of the GDM 100. The fan 350 of the Stirling cooler 300 also may align with the condensate pan 800 so as to assist in evaporation.

It should be understood that the foregoing relates to certain disclosed embodiments of the present invention and that numerous modifications or alterations may be made herein without departing from the spirit and scope of the invention as set forth in the following appended claims.

We claim:

1. An enclosure for a refrigerated space, comprising:

a thermosiphon;

said thermosiphon comprising a condenser end and an evaporator end;

a small diameter pipe and a large diameter pipe connecting said condenser end and said evaporator end; and a Stirling cooler, said Stirling cooler driving said thermosiphon to cool said refrigerated space.

2. The enclosure of claim 1, wherein said thermosiphon comprises a phase change refrigerant.

3. The enclosure of claim 2, wherein said phase change refrigerant comprises carbon dioxide.

4. The enclosure of claim 1, wherein said small diameter pipe comprises a diameter of about 0.5 to about 3 millimeters and said large diameter pipe comprises a diameter of about 3 to about 10 millimeters.

5. The enclosure of claim 1, wherein said condenser end comprises a condenser, said condenser positioned adjacent to said Stirling cooler.

6. The enclosure of claim 5, wherein said condenser comprises a condenser block positioned adjacent to said Stirling cooler.

7. The enclosure of claim 5, wherein said condenser comprises a plurality of coils positioned about said Stirling cooler.

8. The enclosure of claim 1, wherein said evaporator end comprises an evaporator.

9. The enclosure of claim 8, wherein said evaporator comprises a fin and tube evaporator.

10. The enclosure of claim 1, further comprising a plurality of thermosiphons and a plurality of Stirling coolers.

11. The enclosure of claim 1, wherein said Stirling cooler comprises a cold end and a hot end and wherein said cold end is positioned adjacent to said thermosiphon.

12. The enclosure of claim 1, further comprising an air movement device positioned adjacent to said thermosiphon so as to force air into said refrigerated space.

13. A refrigerator, comprising:

an insulated frame;

said insulated frame comprising a refrigerated space and a refrigeration deck area; and a removable refrigeration deck positioned within said refrigeration deck area;

said removable refrigeration deck comprising a thermosiphon and a Stirling cooler.

14. The refrigerator of claim 13, wherein said insulated frame comprises a glass door merchandiser.

15. The refrigerator of claim 13, wherein said insulated frame comprises a plurality of walls, said plurality of walls defining said refrigeration deck area.

16. The refrigerator of claim 15, wherein said plurality of walls further define a baffle area.

17. The refrigerator of claim 16, wherein said plurality of walls comprises a drain hole extending between said refrigeration deck area and said baffle area.

18. The refrigerator of claim 13, further comprising an air passageway extending between said refrigerated space and said refrigeration deck area.

19. The refrigerator of claim 13, wherein said thermosiphon comprises a condenser end and an evaporator end.

20. The refrigerator of claim 19, wherein said condenser end comprises a condenser, said condenser positioned adjacent to said Stirling cooler.

21. The refrigerator of claim 19, wherein said evaporator end comprises a fin and tube type evaporator.

22. The refrigerator of claim 13, wherein said removable refrigeration deck comprises a plurality of thermosiphons and a plurality of Stirling coolers.

23. The refrigerator of claim 13, wherein said removable refrigeration deck comprises a top plate.

24. The refrigerator of claim 23, wherein said removable refrigeration deck comprises means to mount said Stirling cooler to said top plate.

25. The refrigerator of claim 23, wherein said top plate comprises an insulated spacer.

26. The refrigerator of claim 23, wherein said top plate comprises a plurality of apertures therein for airflow therethrough.

27. The refrigerator of claim 23, wherein said top plate comprises a handle thereon so as to remove said refrigeration deck.

28. The refrigerator of claim 13, wherein said removable refrigeration deck comprises an air movement device.

29. The refrigerator of claim 13, further comprising an insulated box surrounding said thermosiphon and said Stirling cooler.

30. The refrigerator of claim 29, wherein said refrigeration deck area comprises a first plurality of rails positioned therein and wherein said insulated box comprises a second plurality of rails positioned thereon such that said insulated box may be slid in and out of said refrigeration deck area.

31. A refrigeration deck for a refrigerated space, comprising:

a plate;

a Stirling cooler mounted to said plate; and a thermosiphon connected to said Stirling cooler.

32. The refrigeration deck of claim 31, wherein said plate comprises an insulated spacer.

33. The refrigeration deck of claim 31, wherein said plate comprises a plurality of apertures therein for airflow therethrough.

34. The refrigeration deck of claim 31, wherein said plate comprises a handle thereon so as to remove said refrigeration deck.

35. The refrigeration deck of claim 31, wherein said refrigeration deck comprises an air movement device.

36. The refrigeration deck of claim 31, wherein said Stirling cooler comprises a cold end and a hot end.

37. The refrigeration deck of claim 36, wherein said plate comprises an aperture therein such that said cold end of said Stirling cooler comprises a position on a first side of said plate and said hot end of said Stirling cooler comprises a position on said second side.

38. The refrigeration deck of claim 37, wherein said thermosiphon comprises a condenser block positioned on said cold end of said Stirling cooler.

39. The refrigeration deck of claim 38, wherein said condenser block comprises a mounting flange formed thereon.

40. The refrigeration deck of claim 39, wherein said refrigeration deck comprises an attachment ring, said attachment ring attached to said mounting flange so as to join said condenser block and said cold end of said Stirling cooler.

41. The refrigeration deck of claim 39, wherein said plate comprises an indentation surrounding said aperture.

42. The refrigeration deck of claim 41, wherein said refrigeration deck comprises a vibration mount, said vibration mount positioned within said indentation and supporting said mounting flange and said Stirling cooler.

43. The refrigeration deck of claim 42, wherein said vibration mount comprises a toroidal elastomeric ring.

44. The refrigeration deck of claim 37, wherein said aperture comprises an insulation ring positioned therein.

45. The refrigeration deck of claim 37, wherein said thermosiphon comprises a plurality of condenser coils positioned about said cold end of said Stirling cooler.

46. The refrigeration deck of claim 45, wherein said Stirling cooler comprises an outer casing and wherein said outer casing comprises a plurality of flanges extending therefrom.

47. The refrigeration deck of claim 46, wherein said refrigeration deck further comprises a plurality of isolation mounts, said isolation mounts connecting said plurality of flanges of said Stirling cooler to said plate.

48. The refrigeration deck of claim 47, wherein said plurality of isolation mounts comprises a plurality of cylindrical elastomeric tubes.

49. The refrigeration deck of claim 31, further comprising an insulated box defined by said plate.

50. The refrigeration deck of claim 49, wherein said plate or said insulated box comprise a plurality of guide rails positioned thereon.

51. The refrigeration deck of claim 49, wherein said plate comprises a condenser aperture positioned therein and wherein said Stirling cooler is positioned therein.

52. The refrigeration deck of claim 49, wherein said plate comprises a fan aperture therein and wherein a fan is positioned therein.

53. A method to cool an enclosure with a thermosiphon having a phase change refrigerant therein, a condenser positioned adjacent to a cold end of a Stirling cooler, and an evaporator, said method comprising the steps of:

removing heat from said phase change refrigerant at said condenser by said Stirling cooler so as to turn said phase change refrigerant to a liquid;

flowing said phase change refrigerant to said evaporator;

forcing air past said evaporator and into said enclosure so as to cool said enclosure;

adding heat to said phase change refrigerant at said evaporator by said forced air so as to turn said phase change refrigerant to a vapor; and rising said phase change refrigerant to said condenser.

* * * * *